US008740486B2

(12) United States Patent
Miyashita

(10) Patent No.: US 8,740,486 B2
(45) Date of Patent: Jun. 3, 2014

(54) RECORDING APPARATUS HAVING AN ADVANCED FEED MORE

(75) Inventor: Eiichi Miyashita, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 1178 days.

(21) Appl. No.: 12/166,618

(22) Filed: Jul. 2, 2008

(65) Prior Publication Data

US 2009/0009777 A1 Jan. 8, 2009

(30) Foreign Application Priority Data

Jul. 4, 2007 (JP) ..... 2007-176242

(51) Int. Cl.
*B41J 11/58* (2006.01)

(52) U.S. Cl.
USPC ..... 400/624

(58) Field of Classification Search
USPC ..... 400/624
See application file for complete search history.

(56) References Cited

U.S. PATENT DOCUMENTS 5,021,804 A * 6/1991 Nozawa et al. ..... 347/176
5,223,858 A * 6/1993 Yokoi et al. ..... 346/134
6,978,992 B2 * 12/2005 Otsuka ..... 271/10.01
7,046,380 B2 * 5/2006 Nishiberi et al. ..... 358/1.12
7,178,914 B2 * 2/2007 Marra et al. ..... 347/104

FOREIGN PATENT DOCUMENTS

| | | |
|---|---|---|
| JP | 11-029245 | 2/1999 |
| JP | 2001-039552 | 2/2001 |
| JP | 2001-278472 | 10/2001 |
| JP | 2002-145469 | 5/2002 |
| JP | 2002-361985 | 12/2002 |
| JP | 2003-206038 | 7/2003 |
| JP | 2005-022792 | 1/2005 |

* cited by examiner

*Primary Examiner* — Michael G Lee
*Assistant Examiner* — David Tardif
(74) *Attorney, Agent, or Firm* — Workman Nydegger

(57) ABSTRACT

A recording apparatus includes a feed unit that transports a recording medium from a setting position, a record head that performs recording on the recording medium, a first detection unit that detects passage of a rear end of the recording medium at a predetermined position on the downstream side of the feed unit, and a control unit that controls the feed unit such that the recording medium of a next page reaches a predetermined position until a predetermined timing after detection of the rear end of a preceding page by using the first detection unit for performing an advance feed mode in which the recording medium of the next page is transported from a setting position to the predetermined position without waiting for completion of recording on the preceding page, when the rear end of the preceding page is detected by the first detection unit.

19 Claims, 7 Drawing Sheets

RECORDING APPARATUS HAVING AN ADVANCED FEED MORE

BACKGROUND

1. Technical Field

The present invention relates to a recording apparatus that performs recording on a recording medium, and more particularly, to a recording apparatus having an advance feed mode in which a recording medium of a next page is transported from a setting position to a predetermined position without waiting for completion of recording on a preceding page.

2. Related Art

In recording apparatuses represented by printers, in order to improve throughput thereof, a control operation (so-called advance feed) for starting feed of a next page in advance without waiting for completion of recording on a preceding page, as described in JP-A-2001-278472, JP-A-2002-145469, and JP-A-2005-22792, has been performed.

Recently, in view of convenience of a user's paper sheet setting operation, an increase of the capacity of a cassette in which paper sheets are set has been strongly demanded. However, in a high-capacity paper cassette, lengths of paper feeding paths for a case where paper sheets of a maximum number are set and for a case where paper sheets of a minimum number are set are markedly different from each other. Accordingly, between a case where paper sheets of the maximum number are set and a case where paper sheets of the minimum number are set, a difference of distances (hereinafter, referred to as inter-media distances) between the rear end of the preceding page and the front end of the next page becomes large. In particular, in a case where paper sheets of the minimum number are set, the inter-media distance becomes long, and thereby improvement of the throughput is impeded. In addition, there is a possibility that a feed control operation for the next page is impeded in accordance with non-uniformity of the inter-media distances.

In addition, in serial printers in which recording is performed by alternately performing a main scanning operation and a sub scanning operation, differently from page printers using photosensitive drums as those disclosed in JP-A-2001-278472, JP-A-2002-145469, and JP-A-2005-22792, times required for processing a preceding page may easily be non-uniform. Accordingly, it becomes easy to generate non-uniformity in the inter-media distances. The above-described problems and measures thereof are not described nor implied in JP-A-2001-278472, JP-A-2002-145469, and JP-A-2005-22792.

In addition, in order to prevent a decrease of throughput which is accompanied by an increase of the inter-media distance, a method of setting the paper transporting speed for feeding the next page in advance to a maximum speed all the time regardless of the number of set paper sheets may be considered to be used. However, in such a case, the operation sound of a driving system becomes loud all the time, and there is a possibility that durability of the driving system and rollers for feeding the paper sheet is deteriorated.

SUMMARY

An advantage of some aspects of the invention is to reduce non-uniformity of inter-media distances in an advance feed operation which is accompanied by an increase of the number of set paper sheets, and more particularly, to reduce non-uniformity of inter-media distances by performing an appropriate advance feed control operation in accordance with control of a preceding page in a serial printer. In addition, another advantage of some aspects of the invention is to decrease an operation sound of a driving system that performs an advance feed operation and to prevent a decrease of durability of the driving system.

According to a first aspect of the invention, there is provided a recording apparatus including: a feed unit that transports a recording medium from a setting position; a record head that performs recording on the recording medium; a first detection unit that detects passage of a rear end of the recording medium at a predetermined position on the downstream side of the feed unit; and a control unit that controls the feed unit such that the recording medium of a next page reaches a predetermined position until a predetermined timing after detection of the rear end of a preceding page by using the first detection unit for performing an advance feed mode in which the recording medium of the next page is transported from a setting position to the predetermined position without waiting for completion of recording on the preceding page, when the rear end of the preceding page is detected by the first detection unit.

According to this aspect, the control unit controls the feed unit such that the recording medium of the next page reaches the predetermined position until the predetermined timing (hereinafter, referred to as reference time) after detection of the rear end of a preceding page by using the first detection unit. Accordingly, the position of the next page at the reference time becomes fixed regardless of the number of set recording media, and thereby non-uniformity of inter-media distances after performance of an advance feed mode can be reduced.

In addition, in a serial-type recording apparatus that alternately performs a scanning operation of a record head and an operation for transporting a recording medium, inter-media distances after performance of the advance feed mode becomes the same regardless of the length of time for processing the preceding page, and thereby non-uniformity of inter-media distances can be reduced.

According to a second aspect of the invention, in the above-described recording apparatus, the record head performs recording on the recording medium while moving in a scanning direction, and the predetermined timing is a time when a first scanning operation of the record head for the preceding page is completed after the rear end of the preceding page is detected by the first detection unit.

According to this aspect, the reference time (the predetermined timing) is a time when a first scanning operation of the record head for the preceding page is completed after the rear end of the preceding page is detected by the first detection unit. Accordingly, the inter-media distance can be shorten while the advance feed operation for the next page is performed with time to spare by using a time required for the first scanning operation of the record head.

According to a third aspect of the invention, in the above-described recording apparatus, the control unit calculates a time Tc required for the first scanning operation of the record head for the preceding page on the basis of recording data after the rear end of the preceding page is detected by the first detection unit before the advance feed mode is performed, and the control unit controls the feed unit based on the time Tc.

The time Tc changes based on the recording data. Accordingly, when the feed unit is controlled after setting the time Tc to a predetermined value, there is a case where the recording medium cannot reach the predetermined position until the reference time. However, according to this aspect, the control unit calculates the time Tc in advance before performing the advance feed mode and controls the transport unit (for example, the transport speed or the like) based on the acquired time Tc. Accordingly, the non-uniformity of the inter-media distances after performance of the advance feed mode can be reduced regardless of the time Tc.

According to a fourth aspect of the invention, in the above-described recording apparatus according, the control unit lengthens a time required for performing the advance feed mode in a range that the recording medium of the next page can reach the predetermined position until completion of the first scanning operation of the record head for the preceding page after detection of the rear end of the preceding page by using the first detection unit, based on the time Tc.

In order to prevent a decrease of durability of the feed unit, it is preferable that the feeding speed of the recording medium in the advance feed mode is suppressed as possibly as can be. Here, the time Tc changes based on the recording data. Accordingly, when there is time to spare in the time Tc, the advance feed mode is not necessarily completed quickly, and it is preferable that the whole time Tc is used.

Thus, according to this aspect, a time required for performing the advance feed mode is lengthened in a range that the recording medium of the next page can reach the predetermined position until the reference time. In other words, the transport speed of the recording medium in the advance feed mode is set to be low as possibly as can be. Accordingly, a decrease of the durability of the feed unit can be prevented. In addition, by setting the feeding speed of the recording medium to be low, the precision of position determination in a process for positioning the recording medium in a predetermined position can be improved.

According to a fifth aspect of the invention, in the above-described recording apparatus, a second detection unit that is disposed on the upstream side of the first detection unit and detects passage of the front end of the recording medium is further included. In addition, the control unit positions the recording medium of the next page to the predetermined position by controlling the feed unit based on information on detection of the front end of the next page acquired by the second detection unit, in the advance feed mode.

According to this aspect, the next page is positioned in a predetermined position based on information on detection of the front end of the next page which is acquired by the second detection unit that is disposed on the upstream side of the first detection unit. Accordingly, the precision of position determination for the next page in the advance feed mode is improved, and thereby the non-uniformity of the inter-media distances can be reduced.

According to a sixth aspect of the invention, in the above-described recording apparatus, the preceding page and the next page are synchronously transported with a distance between the rear end of the preceding page and the front end of the next page maintained after the advance feed mode is performed.

According to this aspect, the preceding page and the next page are synchronously transported with a distance between the rear end of the preceding page and the front end of the next page maintained after the advance feed mode is performed. Accordingly, when the recording operation for the preceding page is completed, the next page can be transported to a record starting position in a speedy manner, and thereby the throughput can be improved.

According to a seventh aspect of the invention, in the above-described recording apparatus, a length Lg between the rear end of the preceding page and the front end of the next page is calculated before the synchronous transport is started, and, when the distance Lg is shorter than an allowed distance Lmin that has been determined in advance, the preceding page and the next page are synchronously transported after the distance Lg becomes equal to or longer than the allowed distance Lmin by transporting the preceding page with the transport of the next page stopped.

When the distance Lg (inter-media distance) is short, for example, the front end of the next page reaches close to the record starting position at a time when the recording operation for the preceding page is completed. As a result, there is a possibility that a preliminary operation before start of recording such as a skew eliminating operation cannot be performed. According to this aspect, when the distance Lg is shorter than the allowed distance Lmin that has been determined in advance, the preceding page is transported while stopping the transport of the next page. Accordingly, the preceding page and the next page are synchronously transported after the distance Lg becomes equal to or longer than the allowed distance Lmin. Thereby a preliminary operation before start of the recording operation such as a skew eliminating operation for the preceding page can be appropriately performed.

According to an eighth aspect of the invention, in the above-described recording apparatus, a separation unit that is disposed on the downstream side of the feed unit and separates a preceding page from the next page and the following pages is further included. In addition, the first detection unit is disposed on the downstream side of the separation unit, and the second detection unit is disposed on the upstream side of the separation unit.

According to this aspect, the second detection unit is disposed on the upstream side of the separation unit that separates the preceding page from the next page and the following pages, and the first detection unit is disposed on the downstream side of the separation unit. Accordingly, the front end of the next page can be positioned with high precision on the upstream side of the separation unit, and thereby unintended overlapped transport of the next page can be prevented.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
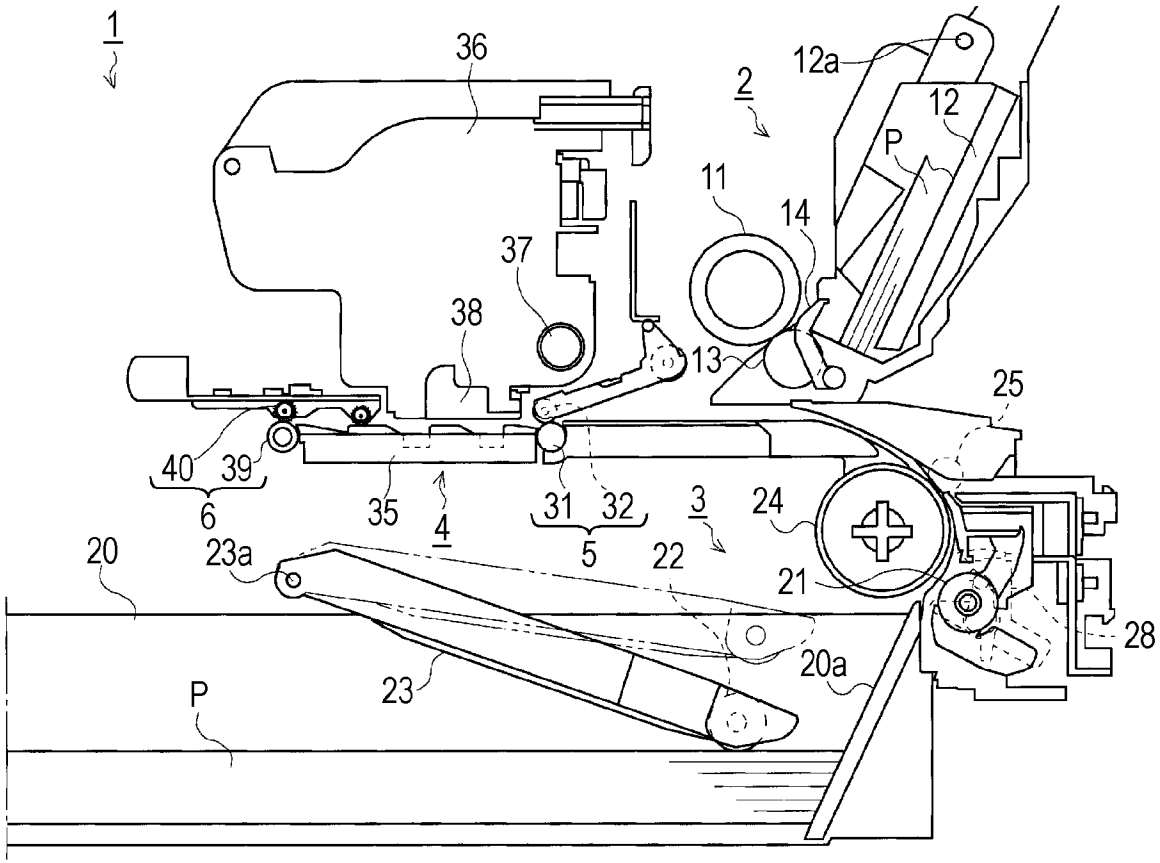
FIG. 1 is a schematic side section view of a printer according to an embodiment of the invention.
Figure 2:
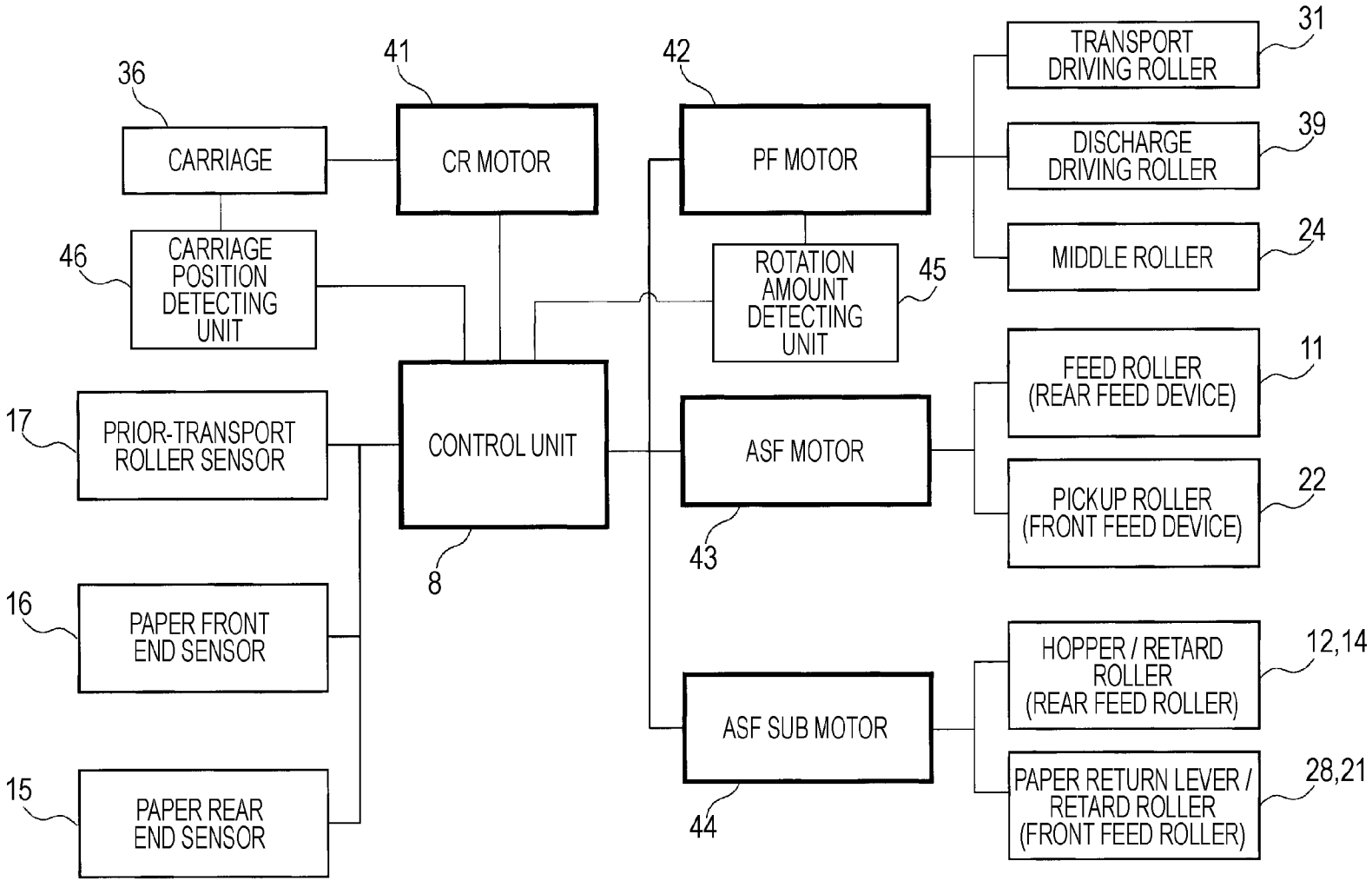
FIG. 2 is a block diagram of a driving system of a printer according to an embodiment of the invention, with a control unit located in the center.
Figure 3:
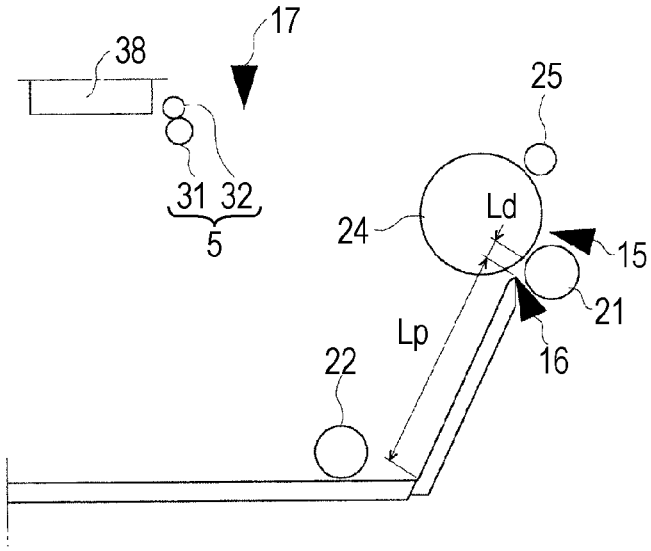
FIG. 3 is a schematic diagram of a paper feeding path from a front feed device to a transport roller pair.
Figure 6:
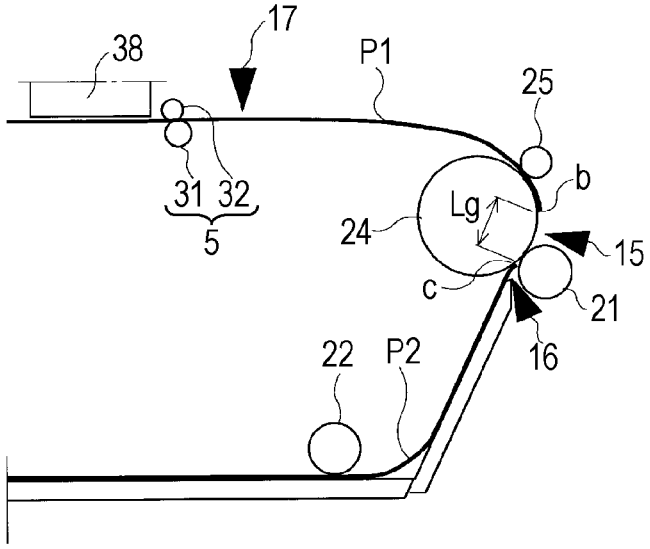
FIG. 6 is a diagram showing the position of a paper sheet in an advance feed mode according to an embodiment of the invention.
Figure 7:
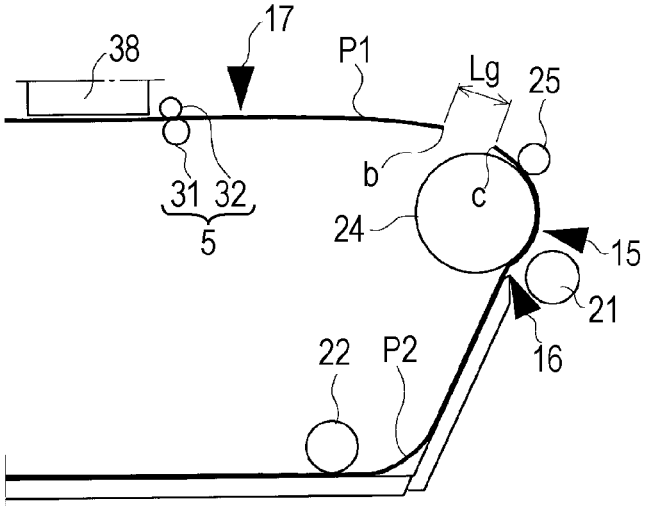
FIG. 7 is a diagram showing the position of a paper sheet in an advance feed mode according to an embodiment of the invention.
Figure 8:
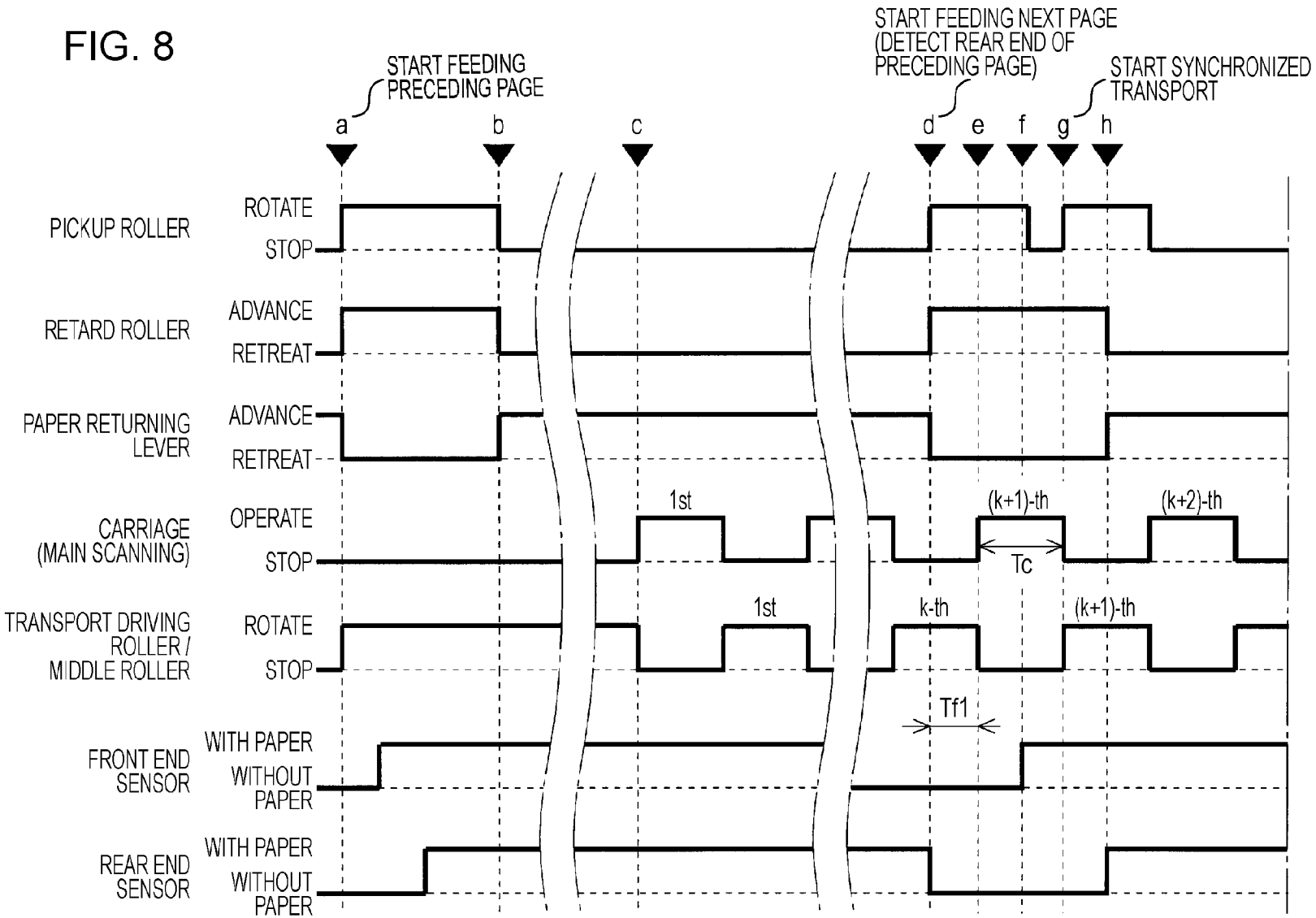
FIG. 8 is a chart diagram showing operation timings of constituent elements of a front feed device according to an embodiment of the invention.
Figure 9:
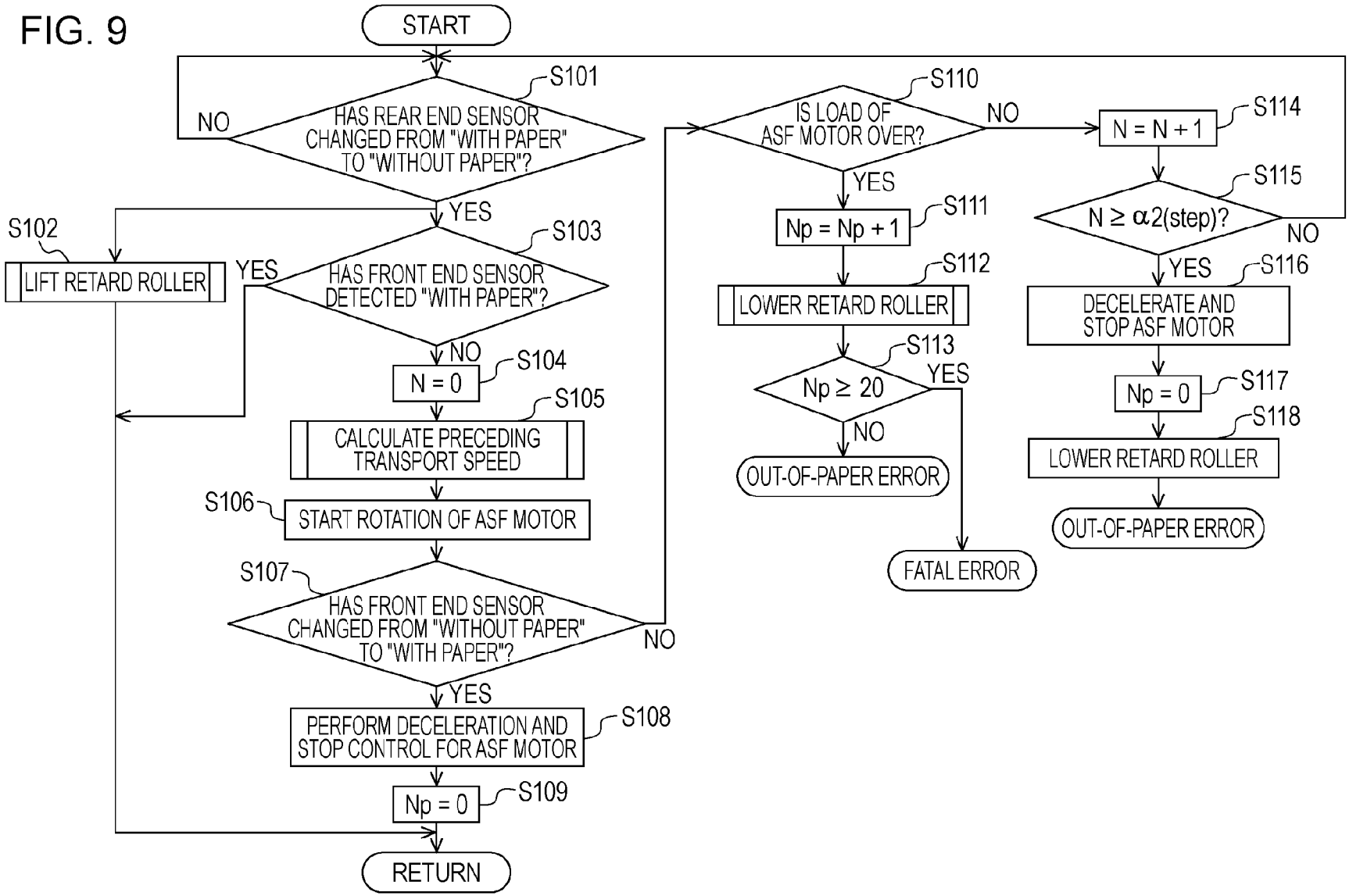
FIG. 9 is a flowchart showing the content of the advance feed mode according to an embodiment of the invention.

Hereinafter, an embodiment of the present invention will be described with reference to the accompanying drawings. FIG. 1 is a schematic side section view of an ink jet printer (hereinafter, referred to as a printer) 1 that is an embodiment of a recording apparatus or a liquid ejecting apparatus according to the invention. FIG. 2 is a block diagram of a driving system, with a control unit 8 located in the center. FIG. 3 is a schematic diagram of a paper feeding path from a front feed device 3 to a transport roller pair 5. FIGS. 4 to 7 are diagrams showing the position of a paper sheet in an advance feed mode. FIG. 8 is a chart diagram showing operation timings of constituent elements of the front feed device 3. FIG. 9 is a flowchart showing the content of the advance feed mode.

Hereinafter, first, the whole configuration of a printer 1 will be described with reference to FIGS. 1 to 2. The printer 1 includes a rear feed device 2 as a first paper feeding unit which is disposed in a rear part of the apparatus and a front feed device 3 according to an embodiment of the invention as a second paper feeding unit which is disposed in the lower part of the apparatus. The printer 1 feeds a recording sheet (mainly a single sheet; hereinafter, referred to as a paper sheet P) as a recording medium or an ejecting medium from the two feed devices to the transport roller pair 5. The paper sheet P is transported to a recording unit 4 by the transport roller pair 5. Then, a recording process is performed for the paper sheet P, and then the paper sheet is discharged to a stacker not shown in the figure by a discharge roller pair 6.

Hereinafter, constituent elements on the paper transporting path will be described in more details.

The rear feed device 2 is configured to have a hopper 12, a feed roller 11, a retard roller 13, and a paper returning lever 14. The hopper 12 shifts between a posture for pressing the paper sheet P supported to be in an inclined posture on the hopper 12 to the feed roller 11 by being pivoted around a pivot position 12*a* located in an upper part and a posture for detaching the paper sheet P from the feed roller 11.

The retard roller 13 is disposed in a state that a predetermined rotation resistance is given and separates an uppermost paper sheet P to be fed from paper sheets P of the next page and the following pages by forming a nip point between the feed roller 11 and the retard roller 13. The paper returning lever 14 is disposed to be rotatable while the paper feeding path is seen on the side. The paper returning lever 14 is rotated for returning the paper sheets P of the next page and the following pages, which have been separated by the retard roller 13, to the upstream side.

The front feed device 3 that is disposed at the bottom of the printer 1 and is configured such that a paper sheet is set from the front side of the device includes a paper cassette 20, a pickup roller 22, a middle roller 24, a retard roller 21, a paper returning lever 28, and an assist roller 25.

In the paper cassette 20 that can be attached and detached from the front side of the device, a plurality of paper sheets P can be set in a stacked state. The uppermost one of the set paper sheets P is transported one by one by the pickup roller 22 that is driven by an ASF motor 43 (FIG. 2) from the paper cassette 20. The pickup roller 22 is disposed in a pivot member 23 that pivots around a pivot shaft 23*a*. The pivot member 23 is continuously brought into contact with the uppermost paper sheet by being biased to the paper sheet side by a bias unit not shown in the figure.

For the paper sheet P transported by the pickup roller 22 serving as the paper feeding unit, a preliminary separation process is performed by a separation inclination surface 20*a*. Then, the paper sheet P progresses to the retard roller 21 that configures a separation unit. The retard roller 21 is disposed in a position for facing the outer peripheral surface of the middle roller 24, and is disposed to be able to advance or retreat with respect to the middle roller 24. When a paper sheet is transported from the paper cassette 20, the retard roller is brought into tight contact with the middle roller 24 so as to form a nip point, and thereby separating the uppermost paper sheet P (preceding page) to be transported from paper sheets P of the next page and the following pages.

The paper retuning lever 28 is disposed to be rotatable while the paper feeding path is seen on the side. The paper returning lever is disposed such that the nip point of the middle roller 24 and the retard roller 21 is included in the inner side of a trace drawn by the front end part of the paper returning lever in the rotation operation thereof. When waiting for a feed operation, the paper returning lever 28, as shown in FIG. 1, takes posture in which the front end thereof protrudes in the feed path. On the other hand, when a paper sheet is to be fed, the paper returning lever is rotated in the clockwise direction shown in FIG. 1 and retreats from the paper feeding path so as to open the paper feeding path. When a predetermined time (or a predetermined amount of transport) elapses after the paper feeding operation is started, the paper returning lever 28 is rotated in the counterclockwise direction shown in FIG. 1, that is, in a direction for blocking the paper feeding path. Accordingly, the paper returning lever 28 returns the front ends of paper sheets positioned in a next position and the following positions to the upstream side (the paper cassette 20) which stay in the nip point between the retard roller 21 and the middle roller 24.

The middle roller 24 that configures a transport unit for transporting the paper sheet P fed by the pickup roller 22 to the downstream side together with the transport roller pair 5 is driven by the PF motor 42 (FIG. 2). The middle roller 24 transports the paper sheet to the transport roller pair 5 located on the downstream side by bending and reversing the paper sheet to be fed. The assist roller 25 is brought into contact with the middle roller 24 so as to assist transport of the paper sheet P to the downstream side performed by the middle roller 24.

The transport roller pair 5 is configured to have a transport driving roller 31 that is driven to be rotated by the PF motor 42 (FIG. 2) and a transport driven roller 32 that is brought into contact with the transport driving roller 31 and is driven to be rotated. The paper sheet P of which front end has reached the transport roller pair 5 is transported to the recording unit 4 located on the downstream side by rotating the transport driving roller 31 in a state that the paper sheet is nipped by the transport driving roller 31 and the transport driven roller 32.

The recording unit 4 is configured to have a record head 38 that ejects ink toward the paper sheet P and a paper guide 35 that regulates a distance between a paper sheet P and the record head 38 by supporting the paper sheet P. The record head 38 is disposed at the bottom of the carriage 36. In addition, the record head 38 is driven to reciprocate in the main scanning direction by a CR motor 41 (FIG. 2) while the carriage 36 is guided by a carriage guide shaft 37 that extends in the main scanning direction (the front-rear direction of FIG. 1). Ink cartridges (not shown) that are independent for each of a plurality of colors are loaded into the carriage 36, and ink is supplied from the ink cartridge to the record head 38. So-called an off-carriage method in which the ink cartridges are housed in a casing may be used.

The discharge roller pair 6 that is disposed on the downstream side of the recording unit 4 is configured to have a discharge driving roller 39 that is driven to rotate by the PF motor 42 (FIG. 2) and a discharge driven roller 40 that is driven to rotate by being brought into contact with the discharge driving roller 39. The paper sheet P for which a recording process has been performed by the recording unit 4 is discharged to a stacker not shown in the figure which is disposed on the front side of the device by driving the discharge driving roller 39 to rotate in a state that the paper sheet P is nipped by the discharge driving roller 39 and the discharge driven roller 40.

The printer 1 having the above-described configuration, as shown in FIG. 2, has four motors including a CR motor 41, a PF motor 42, an ASF motor 43, an ASF sub motor 44. The control unit 7 controls driving of the constituent elements that use the motors as sources of power by controlling the motors.

The PF motor 42 is a common driving source of the transport driving roller 31, the discharge driving roller 39, and the middle roller 24. The transport driving roller 31, the discharge driving roller 39, and the middle roller 24 are configured to rotate in synchronization with the rotation of the PF motor 42. The amount of rotation of the PF motor 42 can be detected by a rotation amount detecting unit 45. Accordingly, the amounts and speeds of rotation of the transport driving roller 31, the discharge driving roller 39, and the middle roller 24 can be detected.

The CR motor 41 is a driving source of the carriage 36. The carriage 36 (the record head 38) is configured to move in the main scanning direction by the rotation of the CR motor 41. In addition, the position of the carriage 36 in the main scanning direction can be detected by a carriage position detecting unit 46.

The ASF motor 43 is configured to selectively transfer power to any one of the feed roller 11 of the rear feed device 2 and the pickup roller 22 of the front feed device 3 by using a power transfer shifting mechanism not shown in the figure. In addition, the ASF sub motor 44, similarly, is configured to selectively transfer power to any one of the hopper 12 and the retard roller 14 of the rear feed device 2 and the paper returning lever 28 and the retard roller 21 of the front feed device 3 by using a power transfer shifting mechanism not shown in the figure.

The configuration of the printer 1 has been described as above. Hereinafter, an advance feed mode that is performed in the front feed device 3 will be described with reference to FIGS. 3 to 9.

As shown in FIG. 3, near the downstream side of the retard roller 21, a paper rear-end sensor 15 serving as a first detection unit that detects the rear end of a preceding page is disposed. In addition, near the upstream side of the retard roller 21, a paper front-end sensor 16 serving as a second detection unit that detects the front end of the next page is disposed. In addition, on the upstream side of the transport driving roller 31, a prior-transport roller paper sensor 17 that detects passage of the front end or rear end of a paper sheet is disposed.

In this embodiment, the paper rear-end sensor 15 is disposed for detecting the rear end of a preceding page. However, the paper rear-end sensor 15 may be configured to detect passage of the front end of a paper sheet. Similarly, it is apparent that the paper front-end sensor 16 may be configured to detect passage of the rear end of a paper sheet.

Next, a paper feeding operation will now be briefly described. A paper feeding operation for the first page in a case where recording on a plurality of pages is performed or a page in a case where recording on only the page is performed, that is, the paper feeding operation for the first page of a record job is started by start of rotation of the pickup roller 22 and the middle roller 24, start of lifting operation of the retard roller 21, and start of retreating operation of the paper returning lever 28 from the paper feeding path (time point "a" shown in FIG. 8). Accordingly, the uppermost paper sheet among paper sheets set in the paper cassette 20 is output from the setting position.

Figure 4:
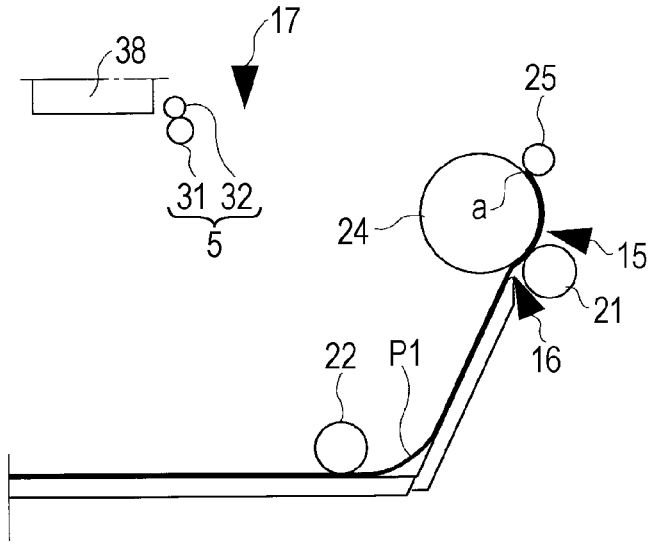
FIG. 4 is a diagram showing the position of a paper sheet in an advance feed mode according to an embodiment of the invention.

When the front end of the output paper sheet is nipped by the middle roller 24 and the retard roller 21, the paper sheet is transported to the downstream side by receiving a transport force from the pickup roller 22 and the middle roller 24 until the front end of the paper sheet is nipped by the middle roller 24 and the assist roller 25. When the front end of the paper sheet is nipped by the middle roller 21 and the assist roller 25, as shown in FIG. 4, the paper sheet can be transported to the downstream side by using only the middle roller 24. Accordingly, the pickup roller 22 is stopped, and the retard roller 21 is detached from the middle roller 24 (time point "b" shown in FIG. 8).

Figure 5:
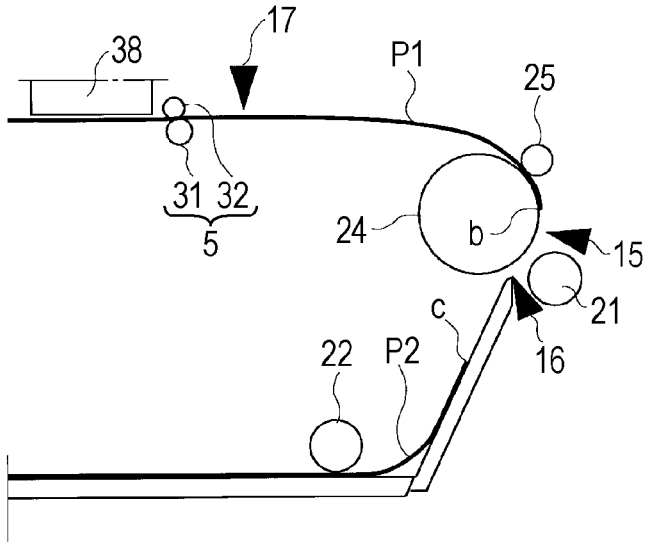
FIG. 5 is a diagram showing the position of a paper sheet in an advance feed mode according to an embodiment of the invention.

At this moment, the paper returning lever 28 advances to the paper feeding path again and stays between the middle roller 24 and the retard roller 21. Then, paper sheets of the next page and the following pages (paper sheets to be overlapped and transported) are returned to the paper cassette 20 (at time point "b" shown in FIG. 8). In FIG. 4, reference sign "a" represents the front end of the proceeding page. In FIGS. 5 to 7, reference sign "b" represents the rear end of the proceeding page, and reference sign "c" represents the front end of the next page.

Thereafter, the fed paper sheet is inserted into the transport roller pair 5 and then is transported to the downstream side by a predetermined amount. Next, the fed paper sheet is ejected to the upstream side from the transport roller pair 5 momentarily by an operation of reverse rotation of the transport driving roller 31 (in a time interval of "b" to "c" of FIG. 8 (not shown)). By performing this operation, skew of the paper sheet is eliminated (skew eliminating operation by using a so-called bite ejecting method). Then, the position of the front end of the paper sheet is adjusted to a front end position adjusting position, and the recording operation is started (time point "c" of FIG. 8; first main scanning).

As shown in FIG. 8, the printer 1 is a serial printer that performs recording on a paper sheet by alternately performing an operation (main scanning) for moving the carriage 36 (the record head 38) and an operation (sub scanning) for normal rotation of the transport driving roller 31. However, more precisely, in order to improve the throughput of the printer, there is a case where the operation for normal rotation of the transport driving roller 31 is started before the carriage 36 is completely stopped or the operation for moving the carriage 36 is started before the transport driving roller 31 is completely stopped.

In other words, although there are cases where the operation of the carriage 36 and the operation of the transport driving roller 31 are controlled to be overlapped with each other in the chart shown in FIG. 8, however, the chart is represented such that the overlapping control is not performed so as to avoid complexity of the drawing shown in FIG. 8. In the operations of the carriage 36 and the transport driving roller 31, acceleration control and deceleration and stop control are included. In addition, precisely, although the time chart is in the shape of not a rectangle but a trapezoid, in order to prevent complexity of the figure, similarly, it is simply drawn as a rectangular shape in FIG. 8.

Subsequently, when the paper rear-end sensor 15 detects passage of the rear end of the first paper sheet (the preceding page), rotation of the pickup roller 22 is started and lifting of the retard roller 21 and the retreating operation of the paper returning lever 38 from the feed path are started (time point "d" of FIG. 8). In other words, when the paper rear-end sensor 15 detects the passage of the preceding page, an advance feed mode in which a paper sheet of the next page is transported from a setting position to a predetermined position (to be described later) without waiting for completion of recording on the preceding page is performed.

FIG. 5 shows a state at a time point (time point "e" shown in FIG. 8) when the paper transporting operation (k-th paper sheet transporting operation shown in FIG. 8) is completed in a case where the paper rear-end sensor 15 detects the passage of the rear end of the preceding page. In the state, the rear end of the preceding page is transported to the downstream side to some degree from the paper rear-end sensor 15, and the front end of the next page is transported to the downstream side to some degree from the setting position. Thereafter, when the paper front-end sensor 16 detects the front end of the next page (time point "f" shown in FIG. 8), deceleration and stop control of the pickup roller 22 (the ASF motor 43) is performed, the pickup roller 22 is stopped after being rotated by a predetermined amount, and the advance feed mode is completed.

FIG. 6 shows a state after the advance feed mode is performed (time point "g" shown in FIG. 8). In the figure, reference sign Lg denotes a distance between the rear end of the preceding page and the front end of the next page. In this state, synchronized rotation of the pickup roller 22 and the middle roller 24 (and the transport driving roller 31) is started, and the rear end of the preceding page and the front end of the next page are synchronously transported to the downstream side with the distance Lg (hereinafter, referred to as an inter-media distance Lg) maintained.

Thereafter, when the front end of the next page reaches a nip point of the middle roller 24 and the assist roller 25 (time point "h" shown in FIG. 8), the pickup roller 22 is stopped, and the retard roller 21 is detached from the middle roller 24. Thereafter, the preceding page and the next page are synchronously transported by the middle roller 24 and the transport driving roller 31 with the inter-media distance Lg maintained (FIG. 7).

The control unit 7 determines whether the inter-media distance Lg after completion of the advance feed mode is smaller than an allowed distance Lmin set in advance, at least before a time point "g" shown in FIG. 8 (for example, before start of a recording job). When the inter-media distance is smaller than the allowed distance, the control unit 9 controls such that the inter-media distance Lg becomes equal to or larger than the allowed distance Lmin set in advance by performing transport operation of the preceding page after completion of the advance feed mode while stopping the transport operation of the next page. This control operation is needed for acquiring an inter-media distance equal to or larger than a predetermined value required for performing a skew eliminating operation using the bite ejection method.

Next, in the advance feed mode, the control unit 7 sets the speed of rotation of the pickup roller 22 such that the front end of the next page reaches a predetermined position until a predetermined timing after the rear end of the preceding page is detected by the paper rear-end sensor 15.

In this embodiment, the predetermined timing is a time point when the first main scanning operation for the preceding page is completed (time point "g" shown in FIG. 8; hereinafter, referred to as a reference time). In addition, in this embodiment, the predetermined position is a position of a paper sheet (hereinafter, referred to as an advance feed target position) in which the front end of the paper sheet is positioned between the paper front-end sensor 16 and the retard roller 21 (the nip point between the middle roller 24 and the retard roller 21).

Hereinafter, a more detailed description will be followed with reference to FIG. 9. FIG. 9 shows the content of the advance feed mode. The advance feed mode is not used for a feed operation of the first one page (or one page in a case where a recording operation for only the one page is performed) in a case where a recording operation for a plurality of pages is performed.

First, after detecting a change from a state "with a paper sheet" to a state "without a paper sheet" (detecting passage of the rear end of the preceding page) (Step S101: Yes), the paper rear-end sensor 15 determines whether the paper front-end sensor 16 detects a state "with a paper sheet" (Step S103). In addition, simultaneously, the paper rear-end sensor 15 starts an operation for lifting the retard roller 21 (Step S102).

In a case for Step S103: Yes (a case for "with a paper sheet"), the front end of the next page has been transported between the paper front-end sensor 16 and the retard roller 21, and accordingly, an advance feed operation for a paper sheet by using the pickup roller 22 is not performed. On the other hand, in a case for Step S103: No (a case for "without a paper sheet"), an advance feed operation for the next page by using the pickup roller 22 is performed.

In the advance feed operation for the next page by using the pickup roller 22, first, a variable N (to be described later) is reset to be zero (Step S104), and then the speed for transporting the paper sheet by using the pickup roller 22 is calculated (Step S105).

The speed for transporting the paper sheet is set such that the front end of the next page reaches between the paper front-end sensor 16 and the retard roller 21 (the advance feed target position) until the reference time after the rear end of the preceding page is detected by the paper rear-end sensor 15.

Hereinafter, a more detailed description will be followed. FIG. 8 shows that the rear end of the preceding page is detected by the paper rear-end sensor 15 in the middle of the k-th transport operation (normal rotation operation of the transport driving roller 31) for a paper sheet (time point "d" shown in FIG. 8). In addition, it is shown that the first main scanning operation of the record head 38 for the preceding page performed after the detection is the (k+1)-th main scanning operation. Reference sign Tf1 represents a time period from a time when the rear end of the preceding page is detected (time point "d" shown in FIG. 8) to a time when the k-th transport operation for a paper sheet is completed (time point "e" shown in FIG. 8). Reference sign Tc represents a time period required for the (k+1)-th main scanning operation.

The lengths of feed paths are different for a case where the number of paper sheets set in the paper cassette 20 is the maximum and a case where the number of paper sheets set in the paper cassette 20 is the minimum. Accordingly, when the rotation speed of the pickup roller 22 is constant regardless of the number of set paper sheets, there occurs non-uniformity of the inter-media distances Lg at a time when the (k+1)-th transport operation for the preceding page is started (time point "g" shown in FIG. 8).

Accordingly, the rotation speed of the pickup roller 22 is determined with reference to the length of the feed path for the minimum number of set paper sheets such that the advance feed operation for the next page to the predetermined position is completed within the time period of "Tf1+Tc" (until time point "g" shown in FIG. 8). However, it is difficult to calculate time Tf1 in advance, and thus, the rotation speed of the pickup roller 22 is determined such that the feed operation for the next page to the advance feed target position is completed within time Tc.

Here, the length of the feed path to the advance feed target position is "Lp+Ld" shown in FIG. 3 in this embodiment, where reference sign Lp denotes a length of a path from the front end of the paper sheet to the paper front-end sensor 16 in a case where paper sheets of the minimum number are set and reference sign Ld denotes a length of a path from the paper front-end sensor 16 to a position located on the upstream side of the retard roller 21 (the nip point of the retard roller 21 and the middle roller 24).

In addition, the length Ld of the path is set as a distance required for a deceleration and stop control operation of the pickup roller 22 (the ASF motor 43) in this embodiment. In other words, a paper feeding speed is set such that the front end of the next page does not stop over the length Ld of the path (the front end of the paper sheet does not reach the nip point of the retard roller 21 and the middle roller 24) in a case where a deceleration and stop control operation of the pickup roller 22 is performed after the front end of the next page is detected by the paper front-end sensor 16.

As described above, when a time period (a time period required for the deceleration and stop control operation for the pickup roller 22) required for stopping a paper sheet after the front end of the paper sheet is detected by the paper front-end sensor 16 is denoted by TΔ, the target transport speed Vp of the paper sheet of the next page for the length Lp of the path can be acquired, for example, by "Vp=Lp/(Tc−TΔ)".

Referring back to FIG. 9, when rotation of the ASF motor 43 (the pickup roller 22) is started (Step S106) and the paper front-end sensor 106 detects a change from a state "without a paper sheet" to a state "with a paper sheet" (detects passage of the front end of the next page) (Step S107: Yes), the deceleration and stop control operation for the ASF motor 43 (the pickup roller 22) is performed (Step S108), a variable Np (to be described later) is reset to be zero (Step S109), and the advance feed operation is completed.

On the other hand, when the paper front end sensor 16 does not detect passage of the front end of the next page (Step S107: No) although rotation of the pickup roller 22 is started, it is determined whether the load for rotation of the ASF motor 43 (the pickup roller 22) is over (Step S110). Here, for a case where the load for the rotation of the ASF motor 43 (the pickup roller 22) is over, a state "without paper" can be considered. Accordingly, an operation for lowering the retard roller 21 is performed (Step S112), and the advance feed mode is completed with an out-of-paper error.

The variable Np is used for counting the number of times that the load of the rotation of the ASF motor 43 (the pickup roller 22) is determined to be over and is incremented every time the load for the rotation of the ASF motor 43 (the pickup roller 22) is determined to be over (Step S111). As a result, when the variable Np exceeds a predetermined value (for example, 20: Step S113), it is determined that an error occurred in the driving system, and the advance feed mode is completed with a fatal error.

On the other hand, when the load for the rotation of the ASF motor 43 (the pickup roller 22) is determined not to be over (Step S110: No), a variable N used for representing the number of driving steps of the ASF motor 43 is incremented (Step S114). When the variable N exceeds a predetermined value α2 (steps) (Step S115: Yes), out-of-paper is determined, the variable Np is reset to be zero (Step S117), the operation for lowering the retard roller 21 is performed (Step S118), and the advance feed mode is completed with an out-of-paper error.

As described above, the control unit 7 controls the pickup roller 22 such that the next page reaches a predetermined position (the advance feed target position) until a predetermined timing (the reference time) after detection of the rear end of the preceding page by the paper rear-end sensor 15. Accordingly, the position of the next page at the reference time becomes fixed regardless of the number of paper sheets set in the paper cassette 20. In addition, the position of the next page at the reference time becomes fixed regardless of the length of processing time (recording time) for the preceding page. Therefore, the non-uniformity of inter-media distances after performance of the advance feed mode can be reduced.

According to this embodiment, the target transport speed Vp of a paper sheet of the next page can be acquired by "Vp=Lp/(Tc−TΔ)", and thereby the paper feeding speed is set to be low as the time Tc becomes long. In other words, a time required for performing the advance feed mode is lengthened in the range that a paper sheet of the next page can reach the advance feed target position until the first scanning operation of the record head 38 for the preceding page is completed after the rear end of the preceding page is detected by the paper rear-end sensor 15. In other words, the paper feeding speed (the rotation speed of the pickup roller 22) is set to be low as possibly as can be by maximally utilizing the time Tc. Accordingly, it is possible to reduce the non-uniformity of the inter-media distances Lg and prevent reduction of durability of the pickup roller 22 and the driving mechanism thereof and generation of ear-offensive noises.

In addition, in this embodiment, the reference time (the predetermined timing) is set to be a time (time point "g" shown in FIG. 8) when the first scanning operation for the preceding page is completed after detection of the rear end of the preceding page by using the paper rear-end sensor 15. However, the reference time is not limited thereto and, for example, may be set to a time when a second scanning operation or a scanning operation thereafter is completed.

What is claimed is:

1. A recording apparatus comprising:

a feed unit that transports a recording medium from a setting position;

a record head that performs recording on the recording medium;

a first detection unit that detects passage of a rear end of the recording medium at a predetermined position on the downstream side of the feed unit; and a control unit that:

controls the feed unit in an advance feed mode such that a next page of the recording medium is advanced from the setting position in a cassette to a predetermined position after the first detection unit detects passage of the rear end of a preceding page of the recording medium, wherein the control unit, at a predetermined timing after the first detection unit detects passage of the rear end of the recording medium and after the next page has been advanced to the predetermined position, synchronously transports the preceding page and the next page, wherein the predetermined timing is a time point when a first main scanning operation of the record head for the preceding page is completed after the rear end of the preceding page is detected by the first detection unit, and wherein the next page is advanced to the predetermined position during a reference time between the detection of the rear end of the preceding page and completion of the first main scanning operation.

2. The recording apparatus according to claim 1, wherein the control unit calculates a time Tc required for a first scanning operation of the record head for the preceding page on the basis of recording data after the rear end of the preceding page is detected by the first detection unit before the advance feed mode is performed, and wherein the control unit controls the feed unit based on the time Tc, wherein the reference time includes the time Tc.

3. The recording apparatus according to claim 2, wherein the control unit lengthens a time required for performing the advance feed mode in a range that the recording medium of the next page can reach the predetermined position until completion of the first scanning operation of the record head for the preceding page after detection of the rear end of the preceding page by using the first detection unit, based on the time Tc.

4. The recording apparatus according to claim 1, further comprising a second detection unit that is disposed on the upstream side of the first detection unit and detects passage of the front end of the recording medium, wherein the control unit positions the recording medium of the next page to the predetermined position by controlling the feed unit based on information on detection of the front end of the next page acquired by the second detection unit, in the advance feed mode.

5. The recording apparatus according to claim 1, wherein the preceding page and the next page are synchronously transported with a distance between the rear end of the preceding page and the front end of the next page maintained after the advance feed mode is performed.

6. The recording apparatus according to claim 5, wherein a length Lg between the rear end of the preceding page and the front end of the next page is calculated before the synchronous transport is started, and wherein, when the distance Lg is shorter than an allowed distance Lmin that has been determined in advance, the preceding page and the next page are synchronously transported after the distance Lg becomes equal to or longer than the allowed distance Lmin by transporting the preceding page with the transport of the next page stopped.

7. The recording apparatus according to claim 4, further comprising a separation unit that is disposed on the downstream side of the feed unit and separates a preceding page from the next page and the following pages, wherein the first detection unit is disposed on the downstream side of the separation unit, and wherein the second detection unit is disposed on the upstream side of the separation unit.

8. The recording apparatus according to claim 1, wherein the first detection unit is located downstream of a retard roller and upstream of an assist roller, the retard roller being adjacent to a middle roller.

9. The recording apparatus according to claim 1, wherein the first detection unit is located downstream of a retard roller and upstream of an assist roller, the retard roller being adjacent to a middle roller and wherein a second detection unit is disposed on the upstream side of the retard roller and wherein the second detection unit detects passage of the front end of the recording medium.

10. The recording apparatus according to claim 1, wherein the predetermined position is at a nip point between a retard roller and a middle roller that are downstream of the feeding unit.

11. The recording apparatus according to claim 1, wherein:

the control unit controls a transport speed of the next page and the transport speed is independent of a transport speed of the preceding page during the advance feed mode; and the control unit, at a predetermined timing after the first detection unit detects passage of the rear end of the recording medium and after the next page has been advanced to the predetermined position, synchronously transports the preceding page and the next page.

12. The recording apparatus according to claim 1, further comprising a transport roller, wherein:

the feed unit includes a middle roller and a pickup roller;

the transport driving roller is positioned downstream of the feed unit;

the control unit controls a transport speed of the next page and the transport speed is independent of a transport speed of the preceding page during the advance feed mode;

the control unit, at a predetermined timing after the first detection unit detects passage of the rear end of the recording medium and after the next page has been advanced to the predetermined position, synchronously transports the preceding page and the next page;

the next page is transported by the pickup roller during the advance feed mode; and the next page and the preceding page are synchronously transported by the middle roller and the transport driving roller after the advance feed mode is completed.

13. The recording apparatus of claim 1, wherein a transport speed of the next page during the advanced feed mode is set such that the advanced feed mode is completed within the reference time between the detection of the rear end of the preceding page and the completion of the first main scanning operation.

14. The recording apparatus of claim 1, wherein a distance between the preceding page and the next page is shortened during the advance feed mode and wherein the distance is maintained when the preceding page and the next page are synchronously transported.

15. A recording apparatus comprising:

a feed unit that transports a recording medium from a setting position;

a record head that performs recording on the recording medium;

a first detection unit that detects passage of a rear end of the recording medium at a predetermined position on the downstream side of the feed unit; and a control unit that:

controls the feed unit in an advance feed mode such that a next page of the recording medium is advanced from the setting position to a predetermined position after the first detection unit detects passage of the rear end of a preceding page of the recording medium, wherein the control unit, at a predetermined timing after the first detection unit detects passage of the rear end of the recording medium and after the next page has been advanced from the setting position to the predetermined position, synchronously transports the preceding page and the next page, and wherein the advanced feed mode is completed during a reference time between the detection of the rear end of the preceding page and the completion of a main scanning operation that occurs after the detection of the rear end.

16. The recording apparatus according to claim 15, wherein:

the control unit controls a transport speed of the next page and the transport speed is independent of a transport speed of the preceding page during the advance feed mode; and the control unit, at a predetermined timing after the first detection unit detects passage of the rear end of the recording medium and after the next page has been advanced from the setting position to the predetermined position, synchronously transports the preceding page and the next page.

17. The recording apparatus according to claim 15, further comprising a transport roller, wherein:

the feed unit includes a middle roller and a pickup roller;

the transport driving roller is positioned downstream of the feed unit;

the control unit controls a transport speed of the next page and the transport speed is independent of a transport speed of the preceding page during the advance feed mode;

the control unit, at a predetermined timing after the first detection unit detects passage of the rear end of the recording medium and after the next page has been advanced from the setting position to the predetermined position, synchronously transports the preceding page and the next page;

the next page is transported by the pickup roller during the advance feed mode; and the next page and the preceding page are synchronously transported by the middle roller and the transport driving roller after the advance feed mode is completed.

18. The recording apparatus of claim 15, wherein a transport speed of the next page during the advanced feed mode is set such that the advanced feed mode is completed within the reference time between the detection of the rear end of the preceding page and the completion of the first main scanning operation.

19. The recording apparatus of claim 15, wherein a distance between the preceding page and the next page is shortened during the advance feed mode and wherein the distance is maintained when the preceding page and the next page are synchronously transported.

* * * * *